United States Patent [19]

Rosen

[11] Patent Number: 4,858,341

[45] Date of Patent: Aug. 22, 1989

[54] ADJUSTABLE GIRTH SHOE CONSTRUCTIONS

[76] Inventor: Henri E. Rosen, 229 Coolidge Ave., Watertown, Mass. 02172

[21] Appl. No.: 226,403

[22] Filed: Jul. 29, 1988

[51] Int. Cl.[4] ..... A43B 3/26

[52] U.S. Cl. ..... 36/97; 36/88

[58] Field of Search ..... 36/12, 88, 91, 97

[56] References Cited

U.S. PATENT DOCUMENTS 3,404,468 10/1968 Rosen ..... 36/97

3,541,708 11/1970 Rosen ..... 36/97

*Primary Examiner*—Werner H. Schroeder

*Assistant Examiner*—D. Biefeld

*Attorney, Agent, or Firm*—Bruce F. Jacobs

[57] ABSTRACT

A shoe construction which is adjustable in girth to accommodate different foot widths includes a shoe upper having side edge margins attached non-elastically to the edges of the shoe sole. At least one side margin of the sole is deformable to permit a vertical component of motion of the corresponding shoe upper side margin with respect to a foot support surface inside the shoe so as to adjust the shoe girth with respect to a foot support surface inside the shoe to accommodate the width of the foot inserted into the shoe. Various shoe constructions for achieving such girth adjustment automatically and manually are disclosed.

30 Claims, 5 Drawing Sheets

ADJUSTABLE GIRTH SHOE CONSTRUCTIONS

This invention relates to shoe constructions and more particularly to shoes constructed to be adjustable in girth for better fit.

BACKGROUND OF THE INVENTION

Since the 1700's, shoe inventions have dealt primarily with ways to make shoes, rather than with ways to make them fit, the latter having been considered the proper province of the manufacturer and his suppliers.

We find ourselves more than two centuries later, with excellent machinery making vast quantities of shoes, most of which do not fit nearly as well as they should.

For a shoe to fit properly, it should have a transverse girth which is substantially the same as the girth of the wearer's foot, girth being the transverse circumference around the foot, typically measured at the ball waist and instep of the foot.

However, foot girth dimensions vary over a range of up to two inches for each length size while most popular price shoes now come in only one width per length, to allow marketing of the maximum number of styles with the minimum inventory, for end users who apparently value style and price over the homelier virtues of fit and comfort.

Furthermore, research has shown that a foot usually varies in girth up to two standard widths daily with even greater changes under a variety of physiological conditions causing fluid and/or tissue buildup in the foot.

The prior art has dealt mainly with visible means of girth adjustment such as laces, adjustment straps, and the like, most of which usually do not provide adjustment at the ball of the foot; nor are they useful in the many popular non-adjustable shoe styles, such as boots, slip-ons, loafers, women's pumps, flats, and so forth.

The prior art has also neglected the children's field, where self-adjusting girth would allow a shoe to better fit the growing foot, as well as facilitate the wearing of new slip-on styles that the child would not have to tie or otherwise adjust.

Adjustable girth footwear is not new, as shoes having this capability are disclosed, for example, in my U.S. Pat. Nos. 3,404,468; 3,541,708 and 3,686,777. These prior shoes have a non-stretchable upper with longitudinally extending lower edge margins at least in the forepart of the shoe turned in toward one another and being free of the direct connection to the sole element.

In one version, shown in FIGS. 1 to 8 of the first-mentioned patent, at least one of those edge margins in the forepart of the shoe is connected by way of stretchable elastic sheet material extending under the wearer's foot to the middle of the sole element or to the other edge margin; in other shoe versions depicted in FIGS. 9 to 13 of that same patent, those edge margins are connected via the elastic material to the edges of the sole element. All of those shoe constructions provide automatic adjustment of the shoe girth to suit the wearer's foot.

The latter two patents above disclose, in lieu of such elastic sheet material, mechanisms for adjusting the spacing of those shoe upper margins so that girth adjustment can be accomplished manually. While those prior shoe constructions have contributed appreciably to the art, they have certain drawbacks which have tended to inhibit their adoption and use. More particularly, in the described first version of that prior shoe, pebbles, dirt and water tend to infiltrate between the upper and the sole element at each lengthwise segment of the shoe where there is no direct connection between the shoe upper and the sole element. Also, the shoe upper tends to pull away from the sole element along each such segment thereby spoiling the appearance of the shoe. In other versions, the elastic sheet material, tends to lose its elasticity due to exposure to sun, ozone, ageing and wear so that the girth adjustment capability of those shoes tends to become degraded over time. Also the elastic material, being a relatively thin sheet of stretch nylon, spandex or the like located right at the sole of the shoe soils easily and is prone to being cut, worn and punctured by contact with curbs, stones and other objects thereby allowing water to penetrate into the shoe. Still further, that exterior stretch material is quite expensive so that shoes of this type would tend not to be economically competitive.

Another technique for adjusting the girth of a shoe essentially by adjusting the elevation of the foot within the shoe is disclosed in U.S. Pat. No. 3,442,031. In this arrangement, a plural-layer auxiliary sole is inserted into the shoe between the insole and sock lining thereby reducing the amount of upper material that extends above the surface that supports the foot. Each of the layers is of such a thickness as to change the girth of the shoe forepart by one standard width. Thus, by removing one layer more upper material is available above that support surface to accommodate a foot one size wider. If a second layer is removed, still more upper material extends above the support surface so that a still wider foot can be accommodated in the shoe. This prior shoe construction is disadvantageous because a person's feet often have different girths or widths. Therefore, adjusting shoe girth in this fashion by elevating the foot within the shoe means that a person's feet may be supported at different heights. This is very undesirable because it has been found that a foot height difference of as little as three sixteenths of an inch is sufficient to cause permanent injury to a person's back and legs. This could tend to provoke heavy liability litigation which the industry as a whole prefers to avoid.

In sum, in all of my prior adjustable girth shoe constructions, the critical lack of a continuous, firm, non-stretchable, nonelastic edge connection between the shoe upper and the sole element all around the shoe has contributed to the lack of acceptance of such constructions. On the other hand, the solution described in the aforementioned U.S. Pat. No. 3,442,031 fails to maintain the designed tread of the last and the shoe and that solution causes the orthopedic and the related liability problems discussed above.

SUMMARY OF THE INVENTION

This invention aims to provide improved adjustable girth footwear constructions.

Another object is to provide footwear of this general type which has a relatively wide range of girth adjustment.

A further object is to provide an adjustable girth shoe which is devoid of undesirable openings between the shoe upper and the sole element all around the perimeter of the shoe.

A further object is to provide a shoe which is adjustable girthwise yet has a positive non-elastic connection between the shoe upper and the sole element.

Still another object is to provide such a shoe which is comfortable to wear.

Yet another object is to provide footwear of this type with provision for automatic and/or manual girth adjustment.

A further object of the invention is to provide footwear with a girth adjustment capability that adapts to a wide range of shoe styles and categories for both adults and children.

Still another object is to provide adjustable girth footwear which departs to a minimum extent from its conventional non-adjustable counterparts in terms of style and appearance.

Another object is to provide footwear having the above advantages at competitive costs.

Briefly a shoe made in accordance with this invention has a flexible upper element which is connected non-elastically to a flexible sole element so that there are no unwanted gaps or spaces between those elements. In saying this, we do not mean that the upper is connected to the sole element all around the perimeter of the shoe as would be the case with men's dress shoes, for example. Rather, we mean that where there is a connection between the upper and the sole element particularly in the ball area of the shoe, that connection is a substantially continuous non-elastic connection. For example, the invention is applicable to informal footwear such as sandals which may have openings at the toe, heel or sides of the shoe. Also, when the word "shoe" is used herein, it should be understood to include the different types and styles of footwear commonly worn by adults and children, including flats, loafers, slip-ons, mocassins, pumps, platform shoes, etc.

Means are provided in the shoe for deforming the sole element in the forepart of the shoe relative to the shoe support surface which contacts the underside of the wearer's foot to allow lateral movements of the sole element on at least one side of the shoe. Thus lateral movements of the sole element permit vertical movements of the corresponding side margin of the upper to accommodate the girth of the wearer's foot. In the different shoe constructions to be described, the lateral movements of the sole element may be rolling movements, tilting movements or a combination of these. Such sole element deformations allow sufficient upward movements of the shoe upper side margins to achieve a shoe girth variation or adjustment preferably of at least four standard "width" sizes, e.g. from men's size C to men's size EE, the variation being continuous over that range.

The adjustment of shoe girth is accomplished manually and/or automatically in my different shoe constructions. For the former, a mechanism is included in the shoe which can be set by the wearer to allow deformation of the sole element by a selected amount as determined by the wearer on a trial and error basis. To achieve automatic girth adjustment, girth adjusting means are included in the shoe which tend to maintain the shoe at the minimum girth of its designed girth range, with both sole and upper conforming to the requirements of that minimum girth. Thus, when the wearer puts on the shoe, the sole element deforms only to the extent needed to increase the shoe girth to fit that foot.

While manually adjustable girth will probably be preferred in most athletic or special purpose footwear, automatic girth adjustment may be the preference in most other cases. In children's shoes, for example, automatic girth adjustment is desirable to prevent inaccurate adjustment of the shoe by the child or mother, and to allow the shoe to "grow" girth-wise naturally along with the often rapidly growing child's foot. Such automatic girth adjustment allows the design of slip-on casuals that give proper support for children too young to be able to tie conventional laced shoes, or even to properly adjust the "Velcro" or similar hook and eye material straps often used now as a lace substitute.

By providing for continuous girth adjustment, my shoe constructions permit a given shoe inventory to fit a maximum number of people, yet such shoes avoid the problems discussed above associated with prior adjustable girth shoes which employ different height shoe inserts or elastic material in the shoe upper or in the connection between the upper and the sole element. It should be understood, however, that even though my shoes incorporate all these advantages, the shoes can still be made using conventional shoe manufacturing techniques at a cost that is not significantly more than the cost of making a conventional fixed girth shoe of a similar type or style.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
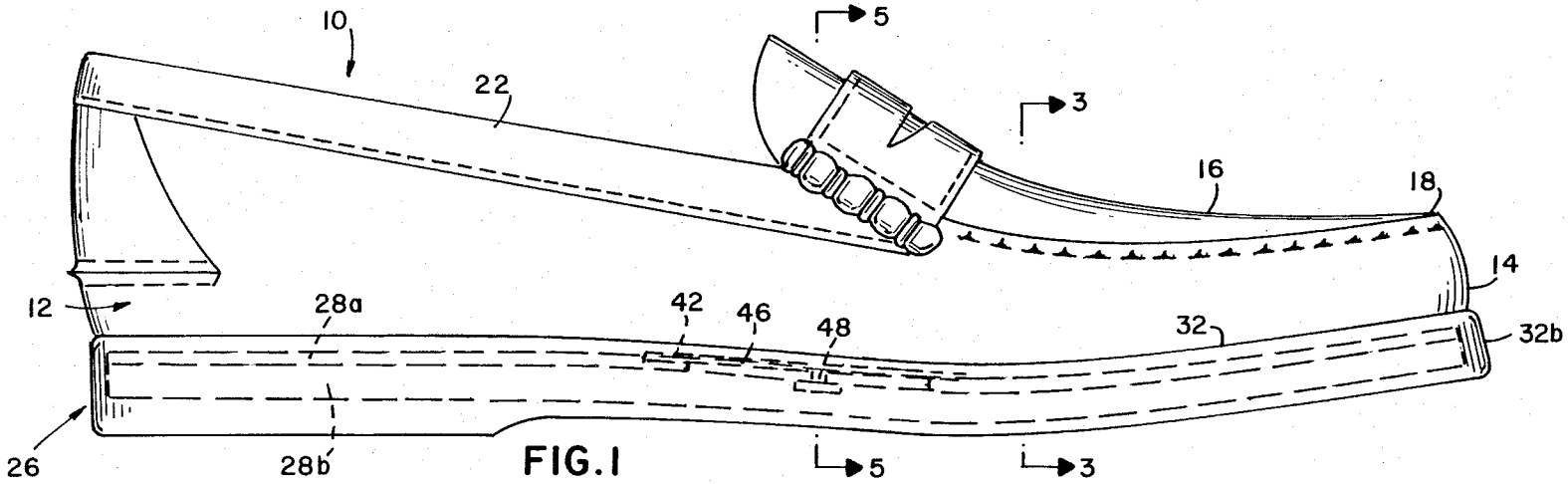
FIG. 1 is a side elevational view with parts broken away of a shoe in accordance with the present invention.
Figure 2:
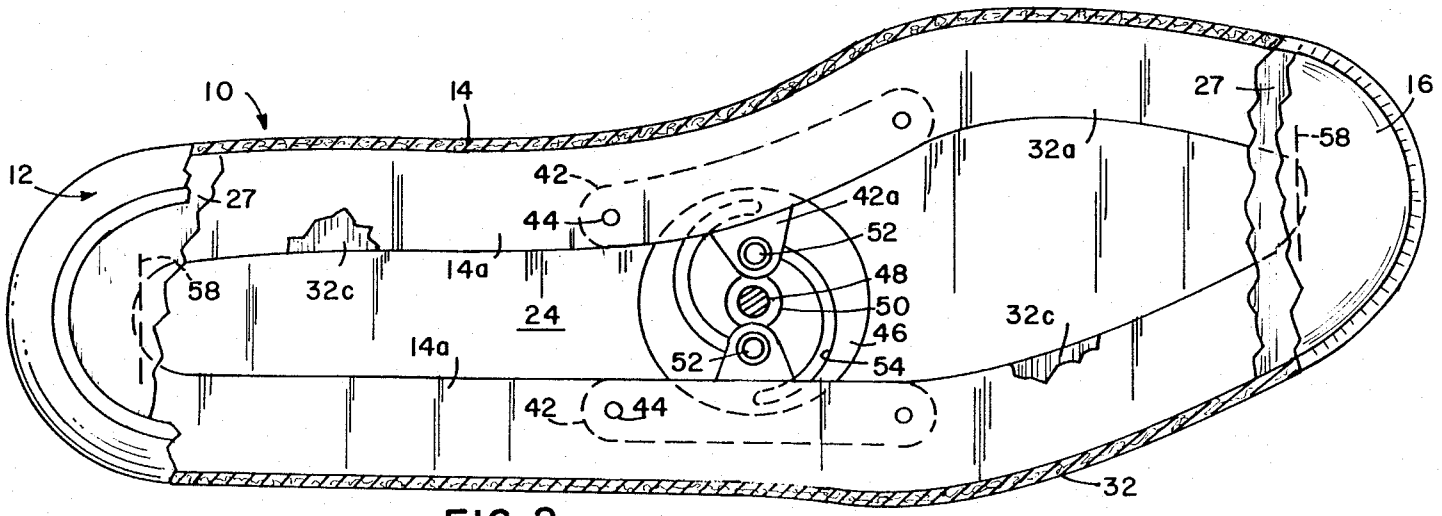
FIG. 2 is a plan view with parts broken away showing the sole assembly of the FIG. 1 shoe.
Figure 3:
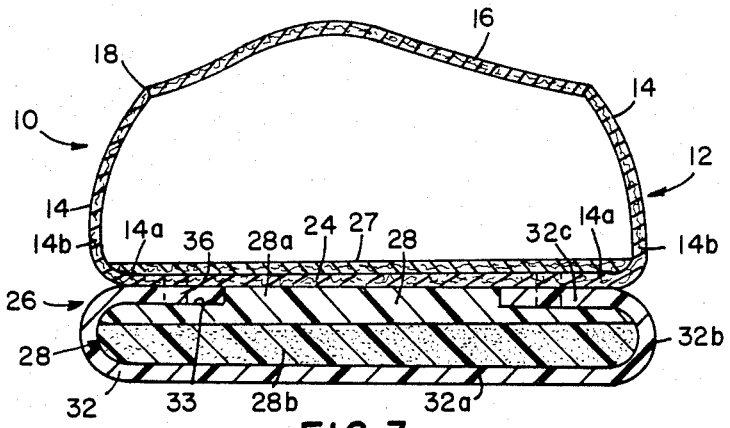
FIG. 3 is a sectional view taking along line 3—3 of FIG. 1 showing the shoe at its minimum girth adjustment.

Refer now to FIGS. 1–3 of the drawings which show a shoe 10 commonly known as a moccasin or loafer, similar to ones shown in my co-pending application of even date herewith entitled "Adjustable Girth Shoes", which disclosure is incorporated herein by reference. The shoe includes a flexible upper shown generally at 12 having a vamp 14 and a plug 16, those elements typically being joined by stitching to form a seam 18 around the forepart of the shoe, with a cuff 22 being provided around the top edge of the back part of the shoe upper 12. The lower edge margins **14*a* of vamp 14 are turned in as shown in FIG. 3 and preferably, although not necessarily, a laterally extensible sock lining or filler 24 extends between those margins 14***a*. The upper 12 is, in turn, stitched, cemented or otherwise secured to a flexible unit sole assembly shown generally at 26. Also, positioned above filler 24 and the shoe upper margins 14*a* is a so-called floating insole 27. Preferably the insole extends the entire interior length and width of the shoe, but is not attached to the shoe upper.

Unit sole assembly 26 comprises a foundation or platform 28 which includes a thin, relatively flexible upper layer 28*a* made of polypropylene or the like and a relatively flexible lower layer 28*b* consisting, for example, of conventional E.V.A. material. Snugly surrounding platform 28 is a flexible molded rubber or plastic unit sole 32. The unit sole has a generally flat bottom surface 32*a*, a pair of gently rounded side walls 32*b* and an in-turned marginal top surface 32*c* that extends all around the unit sole assembly 26. A peripheral recess 33 is provided in the upper surface of platform section 28*a* to provide clearance for the unit sole top surface 32*c*.

As best seen in FIG. 3, the in-turned marginal top surface 32*c* of the unit sole is secured to the in-turned edge margin 14*a* of the shoe upper by stitching 36. Alternatively, if the shoe upper 12 and unit sole 32 are made of materials which can be cemented together either directly or by way of intervening strips of sheet material (not shown), cement may be used to secure those parts together. In either event, the connections between the upper marginal edges 14*a* and the unit sole top surface 32*c* at least at the forepart of the shoe particularly in the ball area thereof, are non-stretchable, non-elastic connections that do not create undesirable gaping between the upper 12 and the sole assembly 26 at the sides of the shoe. Also, those stitches or connections 36 are spaced inward from the side edges of the unit sole assembly 26 at least in the forepart of the shoe, a distance of preferably approximately one centimeter, for reasons that will become apparent.

Figure 4:
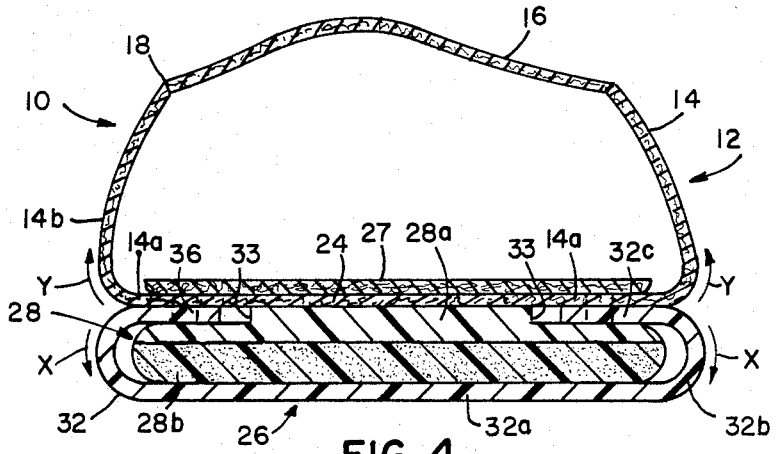
FIG. 4 is a view similar to that of FIG. 3 showing the shoe at an enlarged girth adjustment.

Referring now to FIGS. 3 and 4, unit sole assembly 26 is deformable laterally in that top surface 32*c* of sole element 32 on at least one side, and preferably both sides, of sole assembly 26 is free to slide laterally relative to platform section 28*a* between a minimum girth position illustrated in FIG. 3 and an enlarged girth position shown in FIG. 4. The outward movements of the sole element top surface 32*c* achieve a rolling action with the unit sole element side walls 32*b* as shown by the arrows X in FIG. 4 so that there is little apparent change in the outward appearance of the unit sole assembly 26. Such lateral motion of the sole element top surface 32*c* also allows upward movements of the lower side margins 14*b* of vamp 14 relative to the innersole 28 that contacts and, along with assembly 26, supports the wearer's foot. These movements, shown by the arrows X in FIG. 4, can be considerable and can increase the girth of the shoe by as much as four standard shoe width sizes, as from women's size AAA to B or from men's size C to EE. Conversely, inward sliding movements of the unit sole's top surface 32*c* produces corresponding rolling actions in the opposite directions, of the unit sole side walls 32*b* and downward movements of the side margins of the vamp attached to the unit sole element. The filler panel or sock lining 24 in the shoe upper 12, being extensible or stretchable laterally, accommodates the lateral movements of the sole element top wall 32*c*. However, unlike the elastic insert in the shoe described in my above-mentioned U.S. Pat. No. 3,404,468, the filler panel 24 does not necessarily contribute to any significant extent to the girth adjustment capability of the shoe 10.

Figure 5:
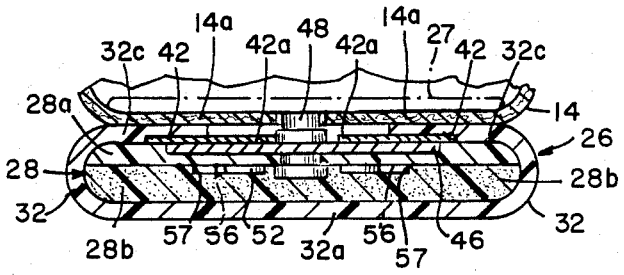
FIG. 5 is a sectional view taking along 5—5 of FIG. 1.

Refer now to FIGS. 1, 2 and 5, provision is made in shoe 10 for adjusting the spacing between the opposite sides of the sole element top wall 32*c* and thereby the girth of the shoe. In the illustrated shoe 10, the means comprise a pair of thin elongated stiffener plates 42 positioned at opposite sides of sole element top wall 32*c* in the waist area of the shoe. Plates 42 extend along, and follow the contours of, the marginal wall 32*c* as best shown in FIG. 2.

The plates are secured to the underside of sole element top wall 32*c* by rivets 44 or other suitable means. Each plate 42 has an integral laterally extending tab 42*a* that extends towards the longitudinal centerline of the shoe. Positioned below plates 42 and their tabs 42*a* is a thin circular cam plate 46, which has a central pin or axle 48 which is rotatably mounted to platform section 28*a*. The upper end of the pin 48 is accessible from inside the shoe through an aperture 50 (FIG. 2) in the filler panel 24 and that end is preferably slotted to facilitate turning the cam plate 46 by a coin or screwdriver. Alternatively, access to the opposite end of the axle may be provided at the underside of the shoe.

As best seen in FIGS. 2 and 5, a pair of follower pins 52 project from tabs 42*a* and engage in oppositely directed spiral cam slots 54 in cam plate 46. When cam plate 46 is rotated in one direction, i.e. counterclockwise in FIG. 2, those pin-in-slot engagements cause the stiffener plates 42 to be spread apart so that the opposite sides of the unit sole element top wall 32*c* are moved apart to their positions of maximum girth adjustment shown in FIG. 4. On the other hand, when the cam plate 46 is rotated in the opposite direction, i.e. clockwise, the camming action of the plate 46 draws the two stiffener plates 42 toward one another to their minimum girth adjustment positions shown in FIG. 3. Conventional detent means (not shown) may be provided to retain plate 46 in its various positions of adjustment. Usually the upper wall 32*c* of the sole element 32 is sufficiently stiff in the lengthwise direction that there is minimal relative longitudinal motion of the stiffener plates 42 when the cam plate 46 is turned. However, if such movement becomes a problem, that can be eliminated by providing transverse slots 56 (FIG. 5) in platform section 28*a* and registering grooves 57 in the top of section 28*b* to receive pins 52 and limit those movements to lateral ones.

When the plates 42 are moved laterally as aforesaid, the opposite sides of top wall 32*c* move correspondingly, the lateral motion of the wall being proportional along the shoe so as not to unduly "crowd" the wearer's foot at the different points along its length. Since there is minimal or no movement of the sole element top surface 32*c* at the toe and heel portions of the shoe, direct connections may be made between the sole element top wall 32*c* and the platform 28 at those locations, as indicated at 58 in FIG. 2.

In order to adjust the girth of shoe 10 to the foot of the wearer, the foot is inserted into the shoe pre-set at its widest girth as in FIGS. 2 and 4. If the shoe at that setting is too wide, the cam plate 46 is turned clockwise as necessary thereby drawing the stiffener plates 42 and the opposite sides of the sole element top surface 32*c* closer together. This results in vertically downward components of motion of the lower side margins of 14*a* vamp 14 relative to the innersole 27 and the underlying platform 28 which support the wearer's foot so that the upper comfortably fits the girth of the foot. Through trial and error, the girth of the shoe 10 can be adjusted to provide an optimal fit to that wearer's foot without affecting in the least the height of the foot within the shoe or above the ground. Moreover, such adjustment of shoe girth, even between its extreme positions, does not materially affect the shape of the shoe sole assembly 26 or the appearance of the shoe generally. Also, even though the shoe 10 is adjustable girthwise, there are no unwanted gaps or openings between the upper 12 and the sole assembly 26 which could spoil the appearance of the shoe or provide avenues for dirt and water penetration into the shoe.

Instead of providing a manual girth adjustment mechanism in shoe 10, alternatively the shoe may include provisions for adjusting the girth automatically to suit the particular foot inserted into the shoe. This simply involves substituting for the illustrated camming mechanism, elastic means tending to draw the stiffener plates 42 together. Optionally also, both manual and automatic means for girth adjustment may be incorporated into the same shoe.

Figure 6:
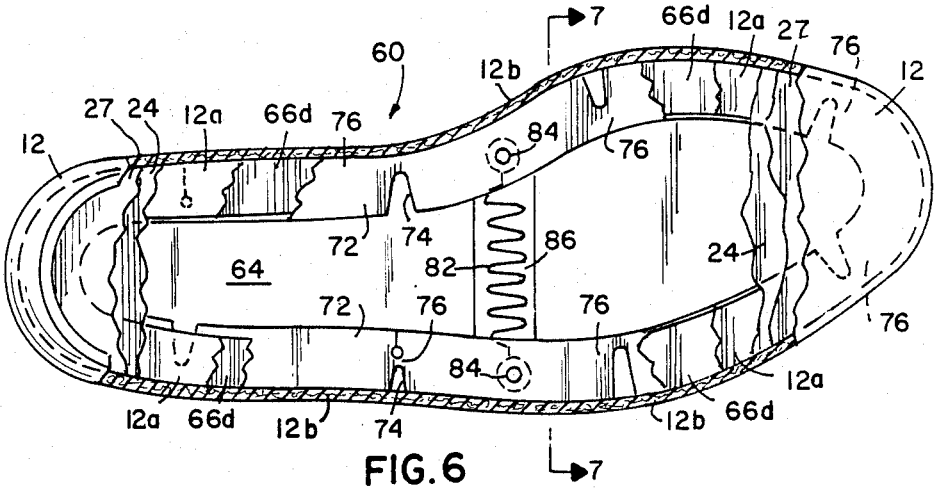
FIG. 6 is a view similar to FIG. 2 of a shoe with a unit sole which provides automatic girth adjustment.
Figure 7:
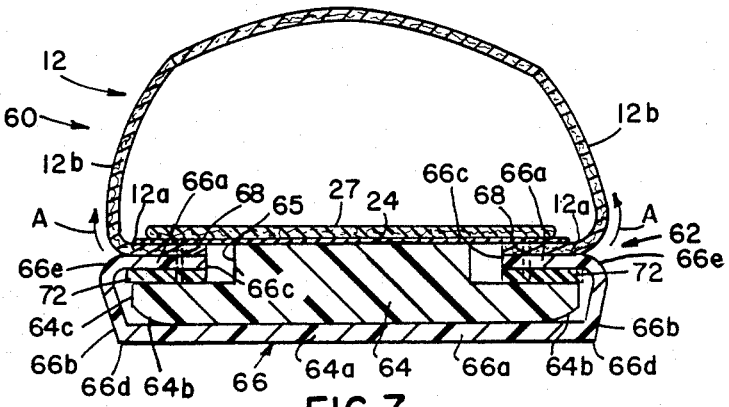
FIGS. 7 and 8 are sectional views taking along line 7—7 of FIG. 6 showing that shoe at its maximum and minimum girth adjustments, respectively.
Figure 8:
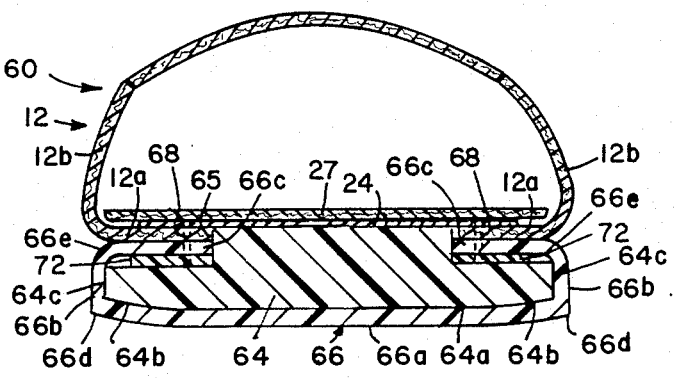

FIGS. 6–8 illustrate a shoe 60 similar to shoe 10 having a somewhat different unit sole assembly which allows automatic girth adjustment. The shoe upper 12 is substantially the same as the one in shoe 10. The inturned lower edge margins 12*a* of the upper 12 are connected non-elastically to a unit sole assembly shown generally at 62. Assembly 62 includes a platform 64 made of flexible, resilient, somewhat compressible material such as cellular E.V.A. plastic. While the undersurface 64*a* of platform 64 is generally flat, between heel breast and toe, the platform undersurface is provided with upwardly curved side margins 64*b* which extend to the substantially vertical side edges 64*c* of the platform. A marginal recess 65 is present in the upper surface of platform 64 all around the perimeter of the platform to provide clearance for the margins of the unit sole assembly 62 and of the shoe upper 12, to which said unit sole margins are attached.

Referring to FIGS. 6 and 7, unit sole assembly 62 includes a flexible, resilient unit sole element 66 which engages snugly around platform 64. The sole element has a bottom surface 66*a*, a side wall 66*b* and an inturned marginal top surface 66*c* which underlies the edge margin 12*a* of the shoe upper. As in shoe 10, the marginal top surface 66*c* of unit sole element 66 is secured to the marginal edge 12*a* of the shoe upper 12 by stitching 68 or other suitable means. Also, secured to the top surface 66*c* at the underside thereof is a stiffener frame 72 which preferably extends all around the shoe. The stiffener frame 72 is thin, (e.g. 0.040 inch) and somewhat flexible and made of a strong, crack-resistant material such as polypropylene.

As best seen in FIG. 6, the stiffener frame has a series of slits and/or notches 74 distributed around the frame creating a similar distribution of living hinges 76 which allow the sides of the frame 72 to flex laterally, i.e. toward and away from one another. The slits or notches 74 and hinges 76 are strategically placed to allow controlled transverse movements of the different lengthwise segments of the frame to achieve proportional motion of the frame sides along the shoe to allow not only for infinitely variable and continual adjustments for the girth of each foot, but also for the different relationships between ball and instep girths of that foot. In other words, the frame functions to control girth adjustment proportions so that at any particular girth adjustment, the shoe has girth measurements at least along the midportion of the shoe similar to those of a conventional fixed girth shoe of the nearest fixed girth.

As best seen, in FIG. 7 the lower edge 66*d* of the sole element 66 has a relatively sharp corner. However, the upper edge 66*e* of that element is rounded. As we shall see, this combination of edge shapes on the sole element, in conjunction with the aforementioned upwardly curved edge margin 64*b* of platform 64, enables the girth of shoe 60 to be adjusted over a relatively wide range of girths.

Referring now to FIG. 8, when the shoe is at its minimum girth adjustment as shown there, the opposite sides of the unit sole element top surface 66*c* and the opposite sides of the stiffener frame 72 are relatively close together and abut the inner wall of the platform recess 65. The opposite sides of the lower edge margin 12*a* of the shoe upper 12, being secured to those elements, are likewise close together relatively, with filler panel 24 extending between those edge margins under the innersole 27. Also, in this minimum girth condition, the side margins of the unit sole element bottom surface 66*a* are drawn up against the upwardly curved undersurface edge margins 64*b* of platform 64 and the sole element side walls 66*b* lie flush against the vertical edges 64*c*. As shown in FIG. 6, unit sole assembly 62 is biased to this minimum girth condition by at least one spring 82 stretched between a pair of rivets or pins 84 mounted to opposite sides of stiffener frame 72, preferably in the waist area of the shoe. If needed, a shallow transverse slot or channel 86 may be formed in the top wall of platform 64 to provide clearance for the spring. The shoe at its minimum girth adjustment shown in FIG. 8 may be lasted to fit, for example, a foot having a men's size C width.

When a wider foot is inserted into the shoe, it exerts lateral forces on the sides 12*b* of the shoe upper 12. However, the opposite sides of the top surface 66*c* of sole element 66 and of stiffener frame 72 are able to slide laterally in opposite directions. Such motion causes the sides 66*b* of the unit sole element 66 to tilt laterally to some extent as shown in FIG. 7 as the edge margins of the sole element bottom surface 66*a* flex vertically downward toward a flat condition in which they become coplanar with the remainder of that surface.

There is also a rolling action at the rounded upper edge 66*e* of that element allowed by the fact that the stitching 68 is spaced inward from the sides of the sole assembly 62. These two motions of the unit sole element combine to allow vertical components of motion of the lower side margins 12*b* of the shoe upper 12 relative to the innersole 27 which contacts the underside of the wearer's foot. Such vertical components of motion of the upper side margins 12*a*, indicated by the arrows A in FIG. 7, increase the girth of the shoe by just the right amount to accommodate the girth of the foot therein. Sufficient compliance is built into the sock lining or filler panel 24 to accommodate the lateral movements of the upper edge margins 12*a* and, since the innersole 27 has no direct connection to the shoe upper, that member does not interfere with the accommodation of the shoe to that larger girth foot.

If a still wider foot is inserted into the shoe, there is a further outward tilting of the unit sole element side walls 66*b* coupled with a rolling motion at the rounded upper edge 66*e* of the sole element 66 that combine to allow further vertical movements of the side margins 12*b* of the shoe upper relative to the innersole 27. Thus, additional shoe upper material is made available above the innersole 27 to increase the overall shoe girth by just the right amount to suit that wider foot.

The slight outward tilting of the side walls 66b of the unit sole element 66 that occurs in the forepart of the shoe when the shoe girth is increased as just described is not at all apparent to the wearer and does not change the appearance of the shoe to any material extent. Nor does the girth adjustment affect in the least the height of the wearer's foot either within the shoe or above the walking surface. Therefore, a pair of such shoes can accommodate themselves to feet having different girths without adversely affecting the wearer as do the shoes described at the outset which rely on inserts to change the available space within the shoe upper in order to achieve girth adjustment.

The marginal top surface 66c of sole unit element 66 is prevented from pulling out of recess 65 by the stretch limit of the panel 24 or other suitable limiting member that may be incorporated into the shoe.

Figure 9:
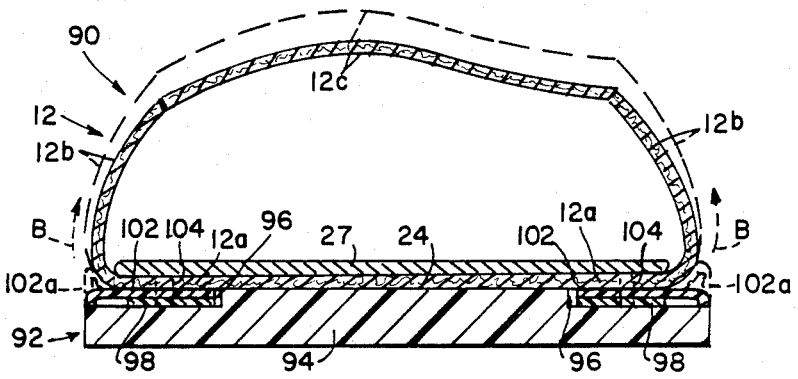
FIG. 9 is a sectional view similar to FIG. 7 showing a further shoe construction for achieving girth adjustment.

It is evident that the shoe construction illustrated in FIGS. 6 to 8 may be modified to provide a manual adjustment of shoe girth simply by substituting for the spring 82, means for manually controlling the spacing between the opposite sides of stiffer frame 72 such as the camming mechanism present in shoe 10 described above. The invention can also be incorporated into shoes of various styles and with various other sole assembly constructions. For example, FIG. 9 illustrates the ball area cross section of a loafer type of shoe 90 wherein the connection of the shoe upper to the sole element is by way of a thin, flexible, preferably integrally molded, inwardly extending marginal top flap 102, extending from the top edge of the sole element. Shoe 90 has an upper 12 which is essentially the same as that of shoes 10 and 60 and a sole assembly 92 that is somewhat different from the other sole embodiments in that it includes a preferably molded unit sole element 94. The unit sole element is molded or otherwise formed with a marginal recess 96 extending around its upper surface which provides a seat for the marginal top flap 102, as well as for a stiffener frame 98 which is similar to stiffener frame 72 described above in connection with FIGS. 6 to 8.

Sandwiched between the stiffener frame 98 and the inturned edge margin 12a of the shoe upper 12 is the marginal top flap 102. Flap 102 is folded inward over frame 98 and secured between the upper edge margin 12a and stiffener frame 98 by stitching or cement 104 which is spaced inward from the sides of sole element 94. The opposite sides of stiffener frame 98 and of flap 102 are movable laterally in recess 96 toward and away from one another just as described above in connection with shoe 60 in FIGS. 6 to 8 between positions of minimum girth adjustment shown in solid lines in FIG. 9 and positions of maximum girth adjustment shown in phantom in that figure.

As the opposite sides of the stiffener frame 98 and of flap 102 move laterally in recess 96 there are concomitant vertical movements of the lower side margins 12b and plug 12c of the shoe upper 12 relative to the shoe innersole 27 and sole element 94. These upward movements, shown by the arrows B, increase the girth of shoe 90 enabling the shoe to accommodate a wider foot. The outward movements of the stiffener frame 98 and, thus, of shoe upper margins 12a are limited by the engagements of the stiffener frame against flap 102 which, as shown in phantom in FIG. 9, forms an upward pleat or fold 102a between the upper 12 and the sole element 94 in the forepart of the shoe where the girth enlargement occurs.

When a spring similar to spring 82 is connected between the opposite sides of the stiffener frame 98, shoe 90 can provide automatic girth adjustment. Alternatively, a manual girth adjustment mechanism similar to the one in shoe 10 may be incorporated into shoe 90 so that the girth of that shoe can be adjusted manually to suit the particular wearer's foot.

Figure 10:
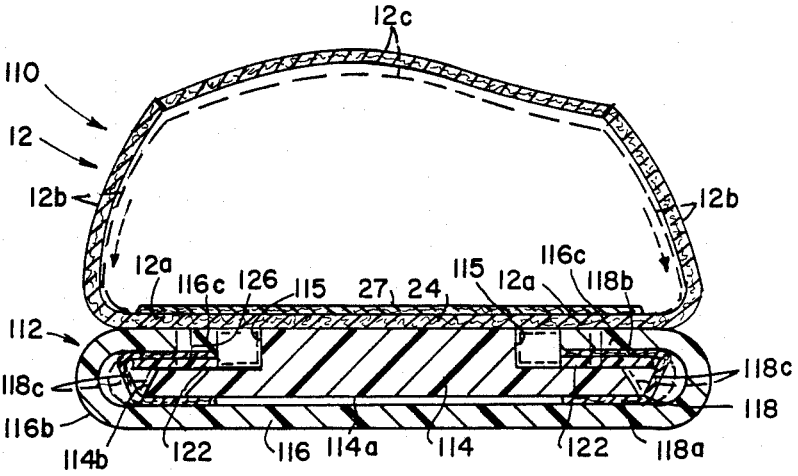
FIG. 10 is a similar view of yet another shoe construction which provides girth adjustment.

FIG. 10 illustrates the ball area cross section of yet another shoe 110 incorporating my invention. This shoe, shown in a girth enlarged condition, has a shoe upper 12 which is essentially the same as the ones in the other shoe constructions described above and a unit sole assembly 112 which includes a platform 114. The platform has a generally flat bottom surface 114a and opposite sides 114b, at least in the midportion of the shoe, which slant upwardly-inwardly, and finally, a marginal recess 115 which extends all around said platform. Wrapped around platform 114 is a unit sole element 116 that is made of a rugged, flexible, non-extensible material such as one of the many unit sole materials now in use. Sole element 116 is secured to platform 114 and to a stiffener frame 122 positioned in recess 115 by means of a flexible, non-stretchable, distortion preventing means such as binding strip 118. More particularly, a lower edge margin 118a of strip 118 is sandwiched between platform surface 114a and the upper surface of sole element 116, with cement being placed on both sides of the strip margin so that the strip margin becomes firmly secured between the platform and the sole element. The upper edge margin 118b of strip 118 is wrapped around the sides of platform 114 and turned inwardly and cemented or otherwise fastened to the top surface of stiffener frame 122, positioned on platform recess 115. This frame may be identical to frame 72 described above. The edge margins of sole element 116 extend up around the sides of platform 114 and strip 118 and are turned inward on top of the strip margin 118b thereby forming the rounded sidewall 116b and inturned top surface 116c of the sole element. That top surface 116c is then preferably cemented or otherwise secured at 126 between the shoe upper edge margins 12a and the strip margin 118b.

The opposite sides of stiffener frame 122 and of the sole element top wall 116c are slidable laterally in recess 115 between a position of maximum girth adjustment shown in solid lines in FIG. 10 and a position of minimum girth adjustment indicated in phantom in that figure. In the latter position, the opposite sides of the stiffener frame 122 abut the inner wall of recess 115 and the strip sides 118c lie flush against the bevelled side wall 114b of platform 114 as shown in phantom in FIG. 10.

The sole assembly may be urged toward this minimum adjustment condition by a spring similar to spring 82 stretched between the opposite sides of stiffener frame 122 to provide automatic girth adjustment. Alternatively, a camming mechanism similar to the one in shoe 10 may be incorporated into the sole assembly if a manual girth adjustment capability is desired. If the foot inserted into shoe 110 calls for a wider girth than the minimum girth of the shoe, the opposite sides of the stiffener frame 122 must be spread apart as described above in connection with the other shoe embodiments. This causes the sole element side walls 116b to roll outwardly-downwardly allowing concomitant vertically upward components of motion of the shoe upper side margins 112*b* relative to innersole 27 and the foot supporting platform 114 thereby increasing the girth of shoe 110 by the amount required to properly fit that wearer's foot.

The distortion preventing means, that is, the inextensible strip 118, prevent the opposite sides of the stiffener member 122 and the sole element edge margins 116*c* from sliding out of recess 115 beyond their positions shown in solid lines in FIG. 10. Just as important, the strip 118 prevents the unit sole assembly 112 from having excessive unsightly differences in apparent side thickness along its length. The distortion preventing means could also comprise parallel monofilaments or the like, disposed between the stiffener member 22 and the lower edge of the platform 114 and/or sole element 116.

Thus to provide girth adjustment, the sole element 116 of shoe 110 deforms by a rolling action of its side walls 116*b* which allows movement including vertical components of motion of the shoe upper sides 112*b* and plug 12*c*. This is in contrast to the shoe 60 depicted in FIG. 7, for example, whose sole element 66 sidewalls deform with both tilting and rolling actions as described above.

Figure 11:
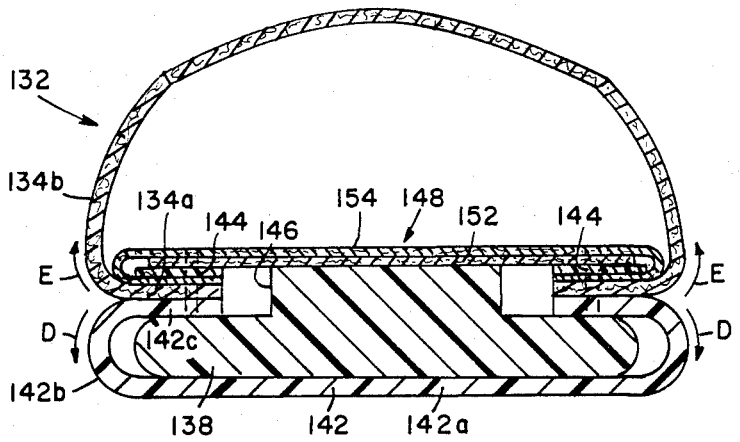
FIGS. 11 and 12 are sectional views similar to FIGS. 7 and 8 illustrating another shoe construction incorporating my invention.
Figure 12:
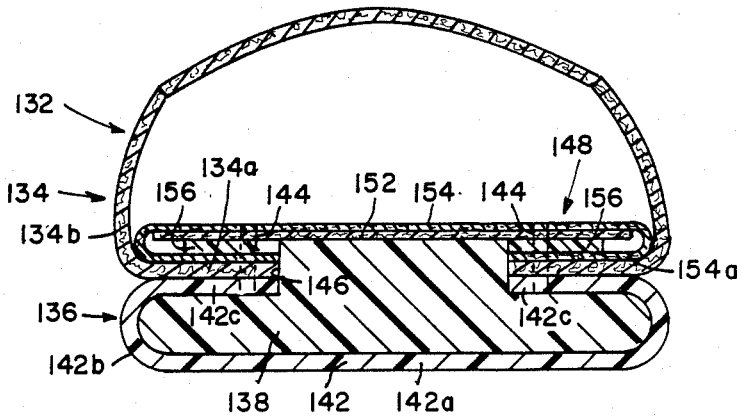

Refer now to FIGS. 11 and 12 which show the ball area cross section of still another shoe embodiment whose sole element deforms by rolling action to achieve girth adjustment. This shoe construction, shown generally at 132, has an upper 134 attached to a unit sole assembly 136. Sole assembly comprises an interior platform or foundation member 138 made of a suitable flexible material such as cellular E.V.A. plastic. Wrapped around the platform member is a preferably molded unit sole element 142 similar to unit sole element 116 described above in connection with FIG. 10. The unit sole element has a relatively flat bottom surface 142*a*, upturned side walls 142*b* and an in-turned marginal top surface 142*c* which is secured by cement or stitching at 144 to the in-turned lower edge margin 134*a* of the shoe upper 134. A marginal recess 146 is provided in the upper surface of platform member 138 to accommodate the marginal connections between the shoe upper and the sole element. These connected-together margins are free to move laterally toward and away from one another as in the other shoe constructions described above.

Positioned in shoe 132 is an insole assembly shown generally at 148. Assembly 148 extends the full length and width of the last bottom of the shoe and comprises a thin flexible support member 152 made of polypropylene or like material. Covering that member is a lining 154 of "Cambrelle" brand or similar fabric Also positioned under the support member 152 is a stiffener frame 156 similar to frame 72 described above and a spring (not shown) similar to spring 82 is stretched between the opposite sides of frame 156. The lining 154 is larger than support member 152 and its edge margin 154*a* is wrapped around the edge of support member 152 and turned inward under stiffener frame 156 where it is secured by cement or other similar means as indicated by the extensions of the cement or stitching lines 144. In practice, the insole assembly 148 would be assembled outside the shoe and then cemented in place.

Shoe 132 when off the foot remains at its position of minimum girth adjustment wherein the edges of the shoe upper margin 134*a* and sole element margin 142*c*, as well as stiffener frame 156, abut the inner wall of recess 146, and the side walls 142*b* of sole element 142 engage snugly around the sides of platform member 138. If the shoe is worn on a foot requiring a girth larger than the shoe's minimum girth, the opposite sides of the sole element's top surface 142*c* slide outwardly while their outer edges and side walls 142*b* roll downwardly as indicated by the arrows D in FIG. 11 in the same manner as the similar sole elements in the FIGS. 3 and 10 shoe constructions described above. That transverse sliding and rolling action allows concomitant vertical movements of the shoe upper side margins 134*b*, as shown by the arrows E in FIG. 11, to increase the amount of upper material above the insole assembly 148 by just the right amount to accommodate that wider foot.

As shown in FIG. 11, as the opposite sides of the stiffener frame 156 spread apart to allow that girth accommodation, the lining 154 unfolds or unrolls around the edge of support member 152 so that the lining still covers the bottom of the shoe interior even when the shoe is in its position of maximum girth adjustment shown in FIG. 11. Thus the transverse sliding and rolling action of the sides of the insole is similar to that of the unit sole's sides as they adjust together to accommodate the girth of the wearer's foot. It should be noted that this type of insole construction could be used in most of the other embodiments disclosed in this application.

It will be seen from the foregoing that all of the shoe constructions incorporating my invention permit manual or automatic adjustment of shoe girth to allow a single shoe to accept a relatively wide range of foot girths. Yet, in all cases, there is a positive, non-elastic securement between the shoe upper and the sole element so that there is no unwanted gaping or opening between those shoe components that could spoil the appearance of the shoe or provide an avenue for the infiltration of dirt and water. Moreover, all of the above shoe constructions can be fabricated using standard shoe manufacturing techniques so that the invention can be incorporated into shoes without increasing costs appreciably above the costs of conventional shoes of equivalent types and styles.

It is apparent also that certain changes may be made in the above constructions without departing from the scope of the invention. Therefore, it is intended that all matter contained in the above description or shown in the accompanying drawings shall be interpreted as illustrative and not in a limiting sense.

It is also to be understood that the following claims are intended to cover all of the generic and specific features of the invention herein described.

I claim:

1. A shoe capable of accommodating and fitting different foot widths, said shoe comprising a shoe upper having deformable side members;

a foot support surface extending at least between the lower edge margins of the upper side members for supporting a foot inserted in the shoe;

a sole assembly having a heel portion, a toe portion and a midportion between said heel and toe portions and comprising an insole assembly having a platform member and a sole member having two side margins, said sole member covering at least a portion of said insole member;

said upper side member being fixedly and non-elastically attached to the respective opposite side margins of the sole member, at least one side member of said sole member being disposed in such a manner so as to permit slidable movement relative to the platform member, and being laterally deformable at least at the midportion to permit vertical movement of the corresponding one of said shoe upper side members relative to said foot support surface so as to allow adjustment of the girth of the shoe to accommodate the girth of a foot supported on said support surface.

2. The shoe defined in claim 1 wherein both side margins of said sole member are disposed in such a manner so as to permit slidable movement relative to the platform member and being laterally deformable at least at the midportion to permit vertical movement of the corresponding upper side margins relative to the foot support surface.

3. The shoe defined in claim 1 and further including means positioned in said shoe under said support surface for urging said at least one side edge margin toward the centerline of the shoe.

4. The shoe defined in claim 3 wherein said urging means comprise resilient means connected to said at least one sole member side margin and extending toward the shoe centerline.

5. The shoe defined in claim 4 wherein said resilient means and said foot support surface are included in the insole assembly for said shoe.

6. The shoe defined in claim 5 wherein said insole assembly also includes a stiffener means extending around at least part of the edge margin of said insole assembly and including segments positioned on opposite sides of said insole assembly in the midportion of said shoe, said resilient means acting between said stiffener means segments.

7. The shoe defined in claim 6 wherein said insole assembly also includes a thin flexible insole member overlying said stiffener means inside said shoe and a sock lining covering said insole member and having edge margins secured to said stiffener means, the opposite side margins of said sock lining deforming laterally in opposite directions as the shoe adjusts in girth.

8. The shoe defined in claim 6 wherein said stiffener means are composed of co-functioning segments which move relatively independently to allow variable adjustments for the girth of each foot as well as for the different relationships between the ball and instep girths of that foot.

9. The shoe defined in claim 4 wherein said insole assembly also includes stiffener means, said stiffener means being composed of at least two cooperating segments two of which are positioned on opposite sides of said insole assembly in the midportion area of said shoe, and said resilient means act between said frame segments.

10. The shoe defined in claim 9 wherein said stiffener means are composed of segments which move relatively independently to allow variable adjustments for the girth of each foot as well as for the different relationships between the ball and instep girths of that foot.

11. The shoe defined in claim 9 wherein said unit sole members include an integral marginal relatively inextensible flap connected to said stiffener means and said shoe upper, said flap being deformable to allow said girth adjustment.

12. The shoe defined in claim 9 wherein said sole assembly also includes a thin flexible insole member overlying said stiffener frame inside said shoe.

13. The shoe defined in claim 3 and further including means in said shoe for allowing limited lateral movement of said at least one sole element side edge margin.

14. The shoe defined in claim 13 wherein said allowing means comprises the a platform member positioned between said shoe upper and said sole member, the undersurface of said platform member having at least one flex-resistant side margin which overlies said at least one side margin of said sole member at the midportion thereof.

15. The shoe defined in claim 14 wherein said at least one sole member side margin moves laterally in a rolling action relative to said platform member.

16. The shoe defined in claim 14 wherein said at least one platform member side margin is spaced vertically from said at least one sole member side edge margin and the latter moves vertically and laterally relative to said platform member in a combined rolling and tilting action.

17. The shoe defined in claim 3 wherein said platform member is positioned between said foot support surface and said sole member and wherein said at least one sole member side edge margin moves laterally relative to the platform member in a rolling action.

18. The shoe defined in claim 17 wherein said urging means comprise longitudinal stiffener means mounted to said at least one sole member side margin in the waist area of said shoe and resilient means urging said stiffener means toward the centerline of said shoe.

19. The shoe defined in claim 18 and further including means for allowing limited lateral movement of said stiffener means relative to the shoe centerline.

20. The shoe defined in claim 19 wherein said allowing means include distortion preventing means connected under said foot support surface and above the bottom of said sole member.

21. The shoe defined in claim 20 wherein said platform member has contoured sides at least in the midportion of said shoe and said distortion preventing means is also connected to said at least one sole member side margin below said platform member so as to inhibit vertical distortion of said sole member.

22. The shoe defined in claim 3 wherein said urging means include a longitudinal stiffener member mounted to said at least one sole member side margin in the midportion of said shoe and control means in said shoe for controlling the spacing between said stiffener member and the centerline of said shoe.

23. The shoe defined in claim 22 wherein at least a second stiffener member is mounted to the other side edge margin of said sole member opposite to said first-mentioned stiffener member and said urging means act between said two stiffener members.

24. The shoe defined in claim 23 wherein said two stiffener members comprise segments of segmented stiffener means that extend along at least part of the edge margin of said shoe.

25. The shoe defined in claim 24 wherein said stiffener means are composed of co-functioning segments which move relatively independently to allow variable adjustments for the girth of each foot as well as for the different relationships between the ball and instep girths of that foot.

26. The shoe defined in claim 22 wherein said second stiffener member is mounted to the other side edge margin of said sole member opposite to said first-mentioned stiffener member and further including means for adjusting the spacings of both said stiffener members from the shoe centerline.

27. The shoe defined in claim 26 wherein said stiffener members permit a relatively proportional girth adjustment along the sole member so that at any girth adjustment, the shoe has girth measurements at least along the midportion of the shoe similar to those of a conventional fixed girth shoe of the nearest fixed girth.

28. The shoe defined in claim 1 wherein said insole assembly further comprises a thin flexible insole member and a sock lining covering said insole member, said sock lining constituting said support surface and having opposite side edges which deform laterally in opposite directions as the shoe adjusts in girth.

29. The shoe defined in claim 28 and further including means positioned between said sock lining and the bottom of said sole member for urging said at least one side edge margin of the sole member toward the centerline of the shoe.

30. The shoe defined in claim 28 and further including control means positioned between said sock lining and the bottom of said sole member for controlling the spacing between said at least one side edge margin of that sole member and the centerline of the shoe.

* * * * *